United States Patent [19]

Futatasuka et al.

[11] Patent Number: 5,024,814

[45] Date of Patent: Jun. 18, 1991

[54] COPPER ALLOY HAVING EXCELLENT HOT ROLLABILITY AND EXCELLENT ADHESION STRENGTH OF PLATED SURFACE THEREOF WHEN HEATED

[75] Inventors: Rensei Futatasuka; Yutaka Koshiba; Shunich Chiba; Toyoaki Orikasa; Seiji Noguchi; Takuya Idoshita, all of Aizuwakamatsu, Japan

[73] Assignee: Mitsubishi Shindoh Co., Ltd., Tokyo, Japan

[21] Appl. No.: 438,584

[22] Filed: Nov. 17, 1989

[30] Foreign Application Priority Data

Feb. 21, 1989 [JP] Japan ..... 1-40908

[51] Int. Cl.[5] ..... C22C 9/04; C22C 9/06

[52] U.S. Cl. ..... 420/473; 420/476; 420/481

[58] Field of Search ..... 420/473, 476, 481

[56] References Cited

U.S. PATENT DOCUMENTS 4,877,577 10/1989 Futatsuka et al. ..... 420/473

4,971,758 11/1990 Suzuki et al. ..... 420/473

FOREIGN PATENT DOCUMENTS 8237 1/1989 Japan .

*Primary Examiner*—Melvyn J. Andrews

*Assistant Examiner*—George Wyszomierski

*Attorney, Agent, or Firm*—Frishauf, Holtz, Goodman & Woodward

[57] ABSTRACT

A copper alloy consists essentially by weight percent of 0.5 to 3% Ni, 0.5 to 2.5% Sn, 0.05 to 0.9% Si, 0.1 to 2% Zn, 0.025 to 0.25% Fe, and the balance of Cu and inevitable impurities. The inevitable impurities include C in an amount of not more than 10 ppm. The obtained copper alloy possesses improved hot rollability and exhibits excellent adhesion strength of a plated surface thereof when heated, while having satisfactory strength and platability.

13 Claims, No Drawings

COPPER ALLOY HAVING EXCELLENT HOT ROLLABILITY AND EXCELLENT ADHESION STRENGTH OF PLATED SURFACE THEREOF WHEN HEATED

BACKGROUND OF THE INVENTION

1. Field Of The Invention

This invention relates to a copper alloy which is excellent in hot rollability as well as adhesion strength of a plated surface thereof when heated, while having high strength and high platability.

2. Background Information

Conventionally, a copper alloy, which has a chemical composition consisting essentially by weight percent of 0.5 to 3 nickel (Ni), 0.5 to 2.5% tin (Sn), 0.05 to 0.9% silicon (Si), 0.1 to 2% of zinc (Zn), and the balance of copper (Cu) and inevitable impurities, has generally been used as a material of electrical parts such as terminals, connectors, and lead frames for semiconductor devices.

The known copper alloy has sufficient strength due to the component elements Ni, Sn, and Si and sufficient platability due to the component element Zn.

However, the known copper alloy is so low in hot rollability that when hot rolled the rolled body is likely to have defects such as ear cracks and surface cracks. To avoid this, hot rolling of the known copper alloy had to be carried out at a low reduction ratio. This, however, requires the hot rolling to be repeatedly executed, resulting in an increased total time period of operation. Even with such repeated hot rolling, the above-mentioned defects cannot be completely eliminated. To remove the defects, the hot rolled body has to be scalped in a considerable amount, and further cracked ears have to be slitted, thus making the manufacturing process complicated and decreasing the yield in the manufacture of electrical parts. Further, the known copper alloy has low adhesion strength of a plated surface thereof in that if the plated surface is heated at a high temperature, there can occur blisters in the plated surface.

SUMMARY OF THE INVENTION

It is the object of the invention to provide a copper alloy which possesses improved hot rollability and exhibits excellent adhesion strength of a plated surface thereof when heated, while having satisfactory strength and platability.

In order to attain the above object, the present invention provides a copper alloy having excellent hot rollability and also exhibiting excellent adhesion strength of a plated surface thereof when heated, which consists essentially by weight percent of 0.5 to 3% Ni, 0.5 to 2.5% Sn, 0.05 to 0.9% Si, 0.1 to 2% Zn, 0.025 to 0.25% Fe, and the balance of Cu and inevitable impurities, wherein the inevitable impurities include C in an amount of not more than 10 ppm.

The above and other objects, features and advantages of the invention will be more apparent from the ensuing detailed description.

DETAILED DESCRIPTION

Under the aforestated circumstances, the present inventors have made studies in order to obtain a copper alloy which is excellent in hot rollability and is free of blisters in a plated surface thereof when heated, while having satisfactory strength and platability, and have reached the following findings:

(a) If Fe is added as an alloying element to the aforementioned known copper alloy, when the resulting alloy is hot rolled, preferably at a temperature of 700° to 900° C., the resulting worked body has greatly reduced ear cracks and surface cracks.

(b) The known copper alloy inevitably includes carbon as an inevitable impurity in an amount of approximately 20 to 50 ppm, which has been mixed into the copper alloy during smelting of the copper alloy material in a crucible formed of graphite in which the molten alloy is covered with charcoal or carbon, as well as during passing of the molten alloy through a trough or a tundish, both coated with a carbon material, and during casting of the molten alloy through a carbon nozzle into a mold formed of graphite. However, it is possible to reduce the carbon content to approximately 10 ppm or less with the aid of the action of oxides contained in the alloying material, if the smelting and casting are carried out in such a manner as to avoid carbon from being mixed into the molten alloy, e.g. by smelting the copper alloy material in a crucible lined with alumina ($Al_2O_3$) in which the molten alloy is covered with a borax-based flux, or in which the molten alloy is gas-sealed, and casting the molten alloy by a semicontinuous casting method using a mold formed of a Cu-Cr-Zr alloy with a borax-based flux as a lubricant. If a copper alloy having a carbon content of 10 ppm or less is plated with a metal such as silver, even when the plated copper alloy is heated to a high temperature, the plated surface has excellent adhesion strength such that there is no blister in the plated surface layer.

The present invention is based upon the above findings.

The contents of the component elements of the copper alloy according to the invention have been limited as previously stated, for the following reasons:

(a) Nickel (Ni)

The nickel acts to enhance the tensile strength as well as the repeated flexural strength, the latter being required when the copper alloy is used as a material of lead frames for semiconductor devices. However, if the nickel content is less than 0.5%, the above action cannot be performed to a desired extent. On the other hand, if the nickel content exceeds 3%, the resulting copper alloy will have degraded hot rollability. Therefore, the nickel content has been limited within a range of 0.5 to 3%, and preferably within a range of 10 to 2.5%.

(b) Tin (Sn)

The tin acts in cooperation with the nickel to further increase the tensile strength and the repeated flexural strength. However, if the tin content is less than 0.5%, the above action cannot be performed to a desired extent. On the other hand, if the tin content is in excess of 2.5%, it causes degradation in the hot rollability, similarly to the nickel. Therefore, the tin content has been limited within a range of 0.5 to 2.5%, and preferably within a range of 0.7 to 2.3%.

(c) Silicon (Si)

The silicon combines principally with the nickel to form silicides such as $Ni_2Si$, which act to increase the tensile strength and also improve the springiness which is required when the copper alloy is used as electrical parts such as terminals and connectors. However, if the silicon content is less than 0.05%, the above action cannot be performed to a desired extent. On the other hand, if the silicon content exceeds 0.9%, the resulting alloy has degraded hot rollability and decreased electric conductivity. Therefore, the silicon content has been limited within a range of 0.05 to 0.9%. The preferable range is 0.1 to 0.7%.

(d) Zinc (Zn)

The zinc serves to improve the platability, i.e. the ability to form a plating layer evenly over the surface of the copper alloy. However, if the zinc content is less than 0.1%. the above action cannot be obtained to a desired extent. On the other hand, if the zinc content exceeds 2%, the platability will not be further improved, but rather degraded. Therefore, the zinc content has been limited within a range of 0.1 to 2%, and preferably within a range of 0.2 to 1.8%.

(e) Iron (Fe)

The iron acts to greatly improve the hot rollability so that the resulting alloy can be hot rolled under the same conditions as those for ordinary copper alloys. The iron imparts excellent hot rollability to the alloy particularly when the hot rolling temperature is in a range Of 700° to 900° C. However, if the iron content is less than 0.025%, the hot rollability cannot be improved to a desired degree. On the other hand, if the iron content exceeds 0.25%, the hot rollability will not be further improved, but rather degraded. Therefore, the iron content has been limited within a range of 0.025 to 0.25%, and preferably within a range of 0.030 to 0.20%.

(f) Carbon (C) As An Inevitable Impurity

As described before, copper alloys in general, including the conventional copper alloy referred to before, contain carbon as an inevitable impurity in amounts of 20 to 50 ppm. However, if such an alloy is plated with a metal and heated to a high temperature, there occur blisters in the plated surface. However, if the carbon content is decreased to 10 ppm or less, the plated surface will exhibit excellent adhesion strength such that it will be free of blisters. Therefore, the carbon content has been limited to not more than 10 ppm.

An example of the invention will now be explained hereinbelow.

EXAMPLE

Copper alloys having chemical compositions as shown in Table were each melted in an ordinary low-frequency channel type smelting furnace accommodating a crucible lined with alumina in which the molten alloy meniscus is sealed with a nitrogen gas, into a molten alloy. Then, the molten alloys were cast by a semi-continuous casting method using a mold formed of a Cu-Cr-Zr alloy with a borax-based flux as a lubricant, to form copper alloy ingots each having a size of 150 mm in thickness, 500 mm in width, and 6000 mm in length. The ingots were each hot rolled at an initial hot rolling temperature of 820° C. into a hot rolled plate having a thickness of 11 mm.

TABLE 1

| | CHEMICAL COMPOSITION (BY WEIGHT %) | | | | | | | | | | |
|---|---|---|---|---|---|---|---|---|---|---|---|
| | Ni | Sn | Si | Zn | Fe | C AS INEVITABLE IMPURITY (ppm) | Cu + INEVITABLE IMPURITIES OTHER THAN C | SURFACE CRACKING | TENSILE STRENGTH (kgf/mm²) | ELONGATION (%) | BLISTERS IN PLATED LAYER |
| COPPER ALLOY STRIPS ACCORDING TO THE PRESENT INVENTION | | | | | | | | | | | |
| 1 | 0.53 | 0.52 | 0.43 | 1.15 | 0.138 | 1 | THE BAL. | A | 60.2 | 7 | NIL |
| 2 | 1.74 | 1.46 | 0.46 | 1.03 | 0.145 | 4 | THE BAL. | A | 64.8 | 8 | NIL |
| 3 | 2.94 | 2.43 | 0.52 | 1.02 | 0.140 | 9 | THE BAL. | A | 69.5 | 12 | NIL |
| 4 | 1.73 | 1.45 | 0.052 | 0.98 | 0.139 | 3 | THE BAL. | A | 62.4 | 8 | NIL |
| 5 | 1.75 | 1.51 | 0.88 | 1.13 | 0.141 | 5 | THE BAL. | A | 66.7 | 8 | NIL |
| 6 | 1.69 | 1.48 | 0.51 | 0.12 | 0.144 | 4 | THE BAL. | A | 64.7 | 8 | NIL |
| 7 | 1.77 | 1.44 | 0.48 | 1.96 | 0.137 | 3 | THE BAL. | A | 65.1 | 8 | NIL |
| 8 | 1.74 | 1.50 | 0.49 | 0.95 | 0.0253 | 2 | THE BAL. | A | 64.4 | 8 | NIL |
| 9 | 1.73 | 1.52 | 0.50 | 0.97 | 0.247 | 5 | THE BAL. | A | 65.6 | 9 | NIL |
| COMPARATIVE COPPER ALLOY STRIPS | | | | | | | | | | | |
| 1' | 0.52 | 0.51 | 0.42 | 1.08 | — | 11 | THE BAL. | B | 60.1 | 7 | PRESENT |
| 2' | 1.74 | 1.44 | 0.48 | 1.02 | — | 17 | THE BAL. | B | 64.9 | 8 | PRESENT |
| 3' | 2.96 | 2.40 | 0.51 | 1.05 | — | 24 | THE BAL. | C | 69.5 | 12 | PRESENT |
| 4' | 1.75 | 1.50 | 0.053 | 0.98 | — | 13 | THE BAL. | B | 62.2 | 8 | PRESENT |
| 5' | 1.73 | 1.47 | 0.87 | 0.99 | — | 18 | THE BAL. | C | 66.5 | 8 | PRESENT |
| 6' | 1.73 | 1.46 | 0.47 | 0.11 | — | 16 | THE BAL. | B | 64.6 | 8 | PRESENT |
| 7' | 1.76 | 1.51 | 0.47 | 1.95 | — | 15 | THE BAL. | B | 64.8 | 8 | PRESENT |

The hot rolled plates were each examined as to whether or not there were cracks in the surfaces thereof, and classified into three classes based on the maximum length of cracks, i.e. class A: 10 mm or shorter, class B: longer than 10 mm and up to 20 mm, and class C: longer than 20 mm. Then, the hot rolled plates each had its opposite sides scalped by 0.5 mm to remove cracks and scales therefrom, followed by repeatedly subjecting them to a cycle of treatments of cold rolling, annealing, and acid pickling into a cold rolled sheet having a thickness of 0.5 mm. After being finally annealed at a temperature of 500° C. for 2 hours, the cold rolled sheets were each finally cold rolled at a reduction ratio of 50 into a cold rolled sheet having a thickness of 0.25 mm. The cold rolled sheets were each annealed to relieve strain in a continuous annealing furnace at a temperature of 500° C. for 20 seconds, and were cut to obtain copper alloy strips Nos. 1–9 according to the present invention.

Comparative copper alloy strips Nos. 1'–7' were also manufactured in the same manner as those of the present invention, except that molten alloys were prepared in a crucible formed of carbon in which the molten alloy meniscus was covered with charcoal, and the molten alloys were cast by a conventional semicontinuous casting method using a mold formed of graphite.

The copper alloy strips Nos. 1–9 according to the present invention as well as the comparative copper alloy strips Nos. 1'–7' were tested as to tensile strength and elongation to evaluate the strength. The test results are shown in Table.

Further, the copper alloy strips Nos. 1–9 and Nos. 1'–7' were each cut into a piece having a size of 25 mm in width and 100 mm in length, and the pieces were each plated with silver by an ordinary electroplating method to form a plating surface layer having a thickness of 2 microns. Thus, test pieces were obtained respectively from the strips Nos. 1-9 and the strips Nos. 1'-7'. The test pieces thus plated with silver were heated at a temperature of 400° C. for 3 minutes. The test pieces after being heated were each examined as to whether or not there were blisters in the plated surface layer. The test results are shown in Table.

According to the test results shown in Table, it is clear that the copper alloy strips Nos. 1-9 according to the present invention, containing Fe as an alloying element, are by far superior in hot rollability to the comparative copper alloy strips Nos. 1' -7', while having almost as high strength as the conventional strips Nos. 1'-7'. Further, no blister was recognized in the copper alloy strips Nos. 1-9 according to the present invention, each of which has a reduced carbon content as an inevitable impurity, which means that they have excellent adhesion strength of the plated surface layer to the copper alloy.

As described above, the copper alloy according to the present invention is so high in strength that electric parts such as lead frames for semiconductor devices, terminals, and connectors can be manufactured therefrom in smaller sizes with smaller thicknesses and shorter lengths. Further, the copper alloy according to the invention is so high in hot rollability that when hot rolled the rolled body will be free of ear cracks and surface cracks to enable minimizing the amount of scalping, thereby decreasing the number of manufacturing steps and increasing the yield in the manufacture of electric parts. In addition, the copper alloy according to the invention has excellent adhesion strength of the plated surface when heated such that no blister occurs in the plated surface, thus assuring high reliability.

What is claimed is:

1. A copper alloy having excellent hot rollability consisting essentially by weight percent of 0.5 to 3% Ni, 0.7 to 2.3% Sn, 0.05 to 0.9% Si, 0.1 to 2% Zn, 0.025 to 0.25% Fe, and the balance being Cu and inevitable impurities, wherein the inevitable impurities include C in an amount of not more than 10 ppm.

2. The copper alloy as claimed in claim 1, consisting essentially of 1.0 to 2.5% Ni, 0.7 to 2.3% Sn, 0.1 to 0.7% Si, 0.2 to 1.8% Zn, and 0.030 to 0.20% Fe.

3. The cooper alloy as claimed in claim 1, wherein the Ni is in an amount of 1.0 to 2.5% weight.

4. The copper alloy as claimed in claim 1, wherein the Zn is in an amount of 0.2 to 1.8% by weight.

5. The copper alloy as claimed in claim 1, wherein the Fe is in an amount of 0.03 to 0.2% by weight.

6. The copper alloy as claimed in claim 1, consisting essentially by weight percent of 1.74 Ni, 1.46 Sn, 0.46 Sn, 0.46 Si, 1.103 Zn and 0.145 Fe, 4 ppm C as an inevitable impurity and the balance being Cu and inevitable impurities other than C.

7. The copper alloy as claimed in claim 1, consisting essentially by weight percent of 1.74 Ni, 1.45 Sn, 0.052 Si, 0.98 Zn and 0.139 Fe, 3 ppm C as an inevitable impurity and the balance being Cu and inevitable impurities other than C.

8. The copper alloy as claimed in claim 1, consisting essentially by weight percent of 1.75 Ni, 1.51 Sn, 0.88 Si, 1.13 Zn and 0.141 Fe, 5 ppm C as an inevitable impurity and the balance being Cu and inevitable impurities other than C.

9. The copper alloy as claimed in claim 1, consisting essentially by weight percent of 1.69 Ni, 1.48 Sn, 0.51 Si, 0.12 Zn and 0.144 Fe, 4 ppm C as an inevitable impurity and the balance being Cu and inevitable impurities other than C.

10. The copper alloy as claimed in claim 1, consisting essentially by weight percent of 1.77 Ni, 1.44 Sn, 0.48 Si, 1.96 Zn and 0.137 Fe, 3 ppm C as an inevitable impurity and the balance being Cu and inevitable impurities other than C.

11. The copper alloy as claimed in claim 1, consisting essentially by weight percent of 1.74 Ni, 1.5 Sn, 0.49 Si, 0.95 Zn and 0.0253 Fe, 2 ppm C as an inevitable impurity and the balance being Cu and inevitable impurities other than C.

12. The copper alloy as claimed in claim 1, consisting essentially by weight percent of 1.73 Ni, 1.52 Sn, 0.5 Si, 1.97 Zn and 0.247 Fe, 5 ppm C as an inevitable impurity and the balance being Cu and inevitable impurities other than C.

13. A copper alloy consisting essentially by weight percent 2.94 Ni, 2.43 Sn, 0.52 Si, 1.02 Zn and 0.14 Fe, 9 ppm C as an inevitable impurity and the balance being Cu and inevitable impurities other than C.

* * * * *